US009972245B2

(12) United States Patent
Wang

(10) Patent No.: US 9,972,245 B2
(45) Date of Patent: May 15, 2018

(54) PIXEL CIRCUIT, DRIVING METHOD FOR THE PIXEL CIRCUIT, DISPLAY PANEL, AND DISPLAY DEVICE

(71) Applicant: BOE TECHNOLOGY GROUP CO., LTD., Beijing (CN)

(72) Inventor: Lirong Wang, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days. days.

(21) Appl. No.: 15/540,113

(22) PCT Filed: Oct. 24, 2016

(86) PCT No.: PCT/CN2016/102997
§ 371 (c)(1),
(2) Date: Jun. 27, 2017

(87) PCT Pub. No.: WO2017/118161
PCT Pub. Date: Jul. 13, 2017

(65) Prior Publication Data

US 2018/0005570 A1 Jan. 4, 2018

(30) Foreign Application Priority Data

Jan. 5, 2016 (CN) ..... 2016 1 0005980

(51) Int. Cl.
*G09G 3/20* (2006.01)
*G09G 3/32* (2016.01)
*G09G 3/3233* (2016.01)

(52) U.S. Cl.
CPC ... *G09G 3/3233* (2013.01); *G09G 2300/0814* (2013.01); *G09G 2310/0243* (2013.01);
(Continued)

(58) Field of Classification Search
CPC ..... G09G 3/3233; G09G 2330/021
See application file for complete search history.

(56) References Cited

U.S. PATENT DOCUMENTS 7,256,758 B2 8/2007 Hu et al.
7,764,248 B2 7/2010 Yamamoto et al.
(Continued)

FOREIGN PATENT DOCUMENTS

CN 1949343 A 4/2007
CN 101019166 A 8/2007
(Continued)

OTHER PUBLICATIONS

International Search Report of PCT/CN2016/102997 in Chinese, dated Jan. 22, 2017 with English translation.
(Continued)

*Primary Examiner* — Xuemei Zheng
(74) *Attorney, Agent, or Firm* — Collard & Roe, P.C.

(57) ABSTRACT

A pixel circuit, a driving method for the pixel circuit, a display panel, and a display device, the pixel circuit includes a selecting module (01), a writing module (02), a driving module (03), and a light emitting element (OLED). When a high-luminance picture needs to be displayed, the selecting module (01) outputs the signal from the first power supply signal terminal (VDDH) to the second node (P2), so that the signal from the first power supply signal terminal (VDDH) drives the light emitting element (OLED) to emit light; when a low-luminance picture is to be displayed, the selecting module (01) outputs a signal from the second power supply signal terminal (VDDL) to the second node (P2), so that the signal from the second power source signal (VDDL) drives the light emitting element to emit light.

19 Claims, 2 Drawing Sheets

(52) U.S. Cl.
CPC . *G09G 2310/08* (2013.01); *G09G 2320/0233* (2013.01); *G09G 2330/021* (2013.01)

(56) References Cited

U.S. PATENT DOCUMENTS

| | | | | |
|---|---|---|---|---|
| 8,963,907 | B2 * | 2/2015 | Tsai | G09G 3/14 345/212 |
| 9,311,849 | B2 | 4/2016 | Qian | |
| 2009/0244110 | A1 | 10/2009 | Ogura | |
| 2011/0134166 | A1 | 6/2011 | Shirasaki et al. | |
| 2013/0127818 | A1 * | 5/2013 | Tsai | G09G 3/14 345/212 |
| 2013/0342114 | A1 * | 12/2013 | Lee | G09G 3/3291 315/169.3 |
| 2014/0320476 | A1 | 10/2014 | Choi et al. | |
| 2017/0116918 | A1 | 4/2017 | Dong et al. | |
| 2017/0140707 | A1 | 5/2017 | Xu et al. | |

FOREIGN PATENT DOCUMENTS

| | | | |
|---|---|---|---|
| CN | 102436793 | A | 5/2012 |
| CN | 103268749 | A | 8/2013 |
| CN | 104715726 | A | 6/2015 |
| CN | 104809989 | A | 7/2015 |
| CN | 105405399 | A | 3/2016 |
| WO | 2006/021922 | A2 | 3/2006 |
| WO | 2015/183523 | A1 | 12/2015 |
| WO | 2017/118161 | A1 | 7/2017 |

OTHER PUBLICATIONS

Notice of Transmittal of the International Search Report of PCT/CN2016/102997 in Chinese, dated Jan. 22, 2017.

Written Opinion of the International Searching Authority of PCT/CN2016/102997 in Chinese, dated Jan. 22, 2017 with English translation.

Chinese Office Action in Chinese Application No. 201610005980.3, dated Jul. 19, 2017 with English translation.

Second Chinese Office Action in Chinese Application No. 201610005980.3, dated Nov. 24, 2017 with English translation.

* cited by examiner

PIXEL CIRCUIT, DRIVING METHOD FOR THE PIXEL CIRCUIT, DISPLAY PANEL, AND DISPLAY DEVICE

CROSS REFERENCE TO RELATED APPLICATIONS

This application is the National Stage of PCT/CN2016/102997 filed on Oct. 24, 2016, which claims priority under 35 U.S.C. § 119 of Chinese Application No. 201610005980.3 filed on Jan. 5, 2016, the disclosure of which is incorporated by reference.

TECHNICAL FIELD

The present disclosure relates to the field of display technology, and more particularly to a pixel circuit, a driving method for the pixel circuit, a display panel, and a display device.

BACKGROUND

With the development of display technology, OLED (Organic Light Emitting Diode) display has become one of the hotspots in the research field of Flat Panel Display. An increasing number of AMOLED (Active Matrix Organic Light Emitting Diode) display panels are available in the market. In comparison to the conventional TFT LCD (Thin Film Transistor Liquid Crystal Display), AMOLED display has a faster response speed, a higher contrast, and a wider viewing angle.

The issue on non-uniformity of luminance between pixels needs to be solved during design of AMOLED panel, and it is known that many types of pixel structures can be used to realize compensation for non-uniformity and drifting of the threshold voltage and thereby solve the non-uniformity issue of OLED light emitting between pixels, but the typical pixel compensating circuit makes pixel structure complicated and causes an increase in power consumption.

Therefore, how to reduce power consumption of the pixel circuit is a technical issue that needs to be solved by those skilled in the art.

SUMMARY

The embodiments of the present disclosure provide a pixel circuit, a driving method for the pixel circuit, a display panel, and a display device, which can reduce power consumption of the pixel circuit.

An embodiment of the present disclosure provides a pixel circuit, comprising a selecting module, a writing module, a driving module, and a light emitting element, wherein a first control terminal of the selecting module is connected with a first node, a first input terminal of the selecting module is connected with a first power supply signal terminal, a second control terminal and a second input terminal of the selecting module are connected with a second power supply signal terminal, and an output terminal of the selecting module is connected with a second node; the selecting module is configured to select a signal from the first power supply signal terminal or a signal from the second power supply signal terminal and to output the selected signal the second node under control of the first node and the second power supply signal terminal;

a control terminal of the driving module is connected with the first node, an input terminal of the driving module is connected with the second node, and an output terminal of the driving module is connected with an input terminal of the light emitting element; the driving module is configured to drive, under control of the first node, the light emitting element to emit light by a signal inputted from the second node;

an output terminal of the light emitting element is connected with a third power supply signal terminal;

a first control terminal of the writing module is configured to input a first control signal, a second control terminal of the writing module is configured to input a second control signal, a first input terminal of the writing module is connected with a data signal terminal, a second input terminal of the writing module is connected with a reference signal terminal, a first output terminal of the writing module is connected with the first node, and a second output terminal of the writing module is connected with the input terminal of the light emitting element; the writing module is configured to write a signal from the data signal terminal to the first node under control of the first control signal, and to initialize, under control of the second control signal, the input terminal of the light emitting element by a signal inputted from the reference signal terminal.

In an optional implementation, in the pixel circuit provided above according to an embodiment of the present disclosure, the selecting module specifically comprises a first switching transistor and a second switching transistor, wherein a gate of the first switching transistor is connected with the first node, a drain of the first switching transistor is connected with the first power supply signal terminal, and a source of the first switching transistor is connected with the second node;

a gate and a source of the second switching transistor are connected with the second power supply signal terminal, and a drain of the second switching transistor is connected with the second node.

In an optional implementation, in the pixel circuit provided above according to an embodiment of the present disclosure, the writing module specifically comprises a data writing unit and an initializing unit, wherein a control terminal of the data writing unit is configured to input the first control signal, an input terminal of the data writing unit is connected with the data signal terminal, and an output terminal of the data writing unit is connected with the first node; the data writing unit is configured to write a signal from the data signal terminal to the first node under control of the first control signal;

a control terminal of the initializing unit is configured to input the second control signal, an input terminal of the initializing unit is connected with the reference signal terminal, and an output terminal of the initializing unit is connected with the input terminal of the light emitting element; the initializing unit is configured to initialize, under control of the second control signal, the input terminal of the light emitting element by a signal inputted from the reference signal terminal.

In an optional implementation, in the pixel circuit provided above according to an embodiment of the present disclosure, the data writing unit specifically comprises a third switching transistor, a gate of the third switching transistor is configured to receive the first control signal, a source of the third switching transistor is connected with the data signal terminal, and a drain of the third switching transistor is connected with the first node.

In an optional implementation, in the pixel circuit provided above according to an embodiment of the present disclosure, the initializing unit specifically comprises a fourth switching transistor;

a gate of the fourth switching transistor is configured to receive the second control signal, a source of the fourth switching transistor is connected with the reference signal terminal, and a drain of the fourth switching transistor is connected with the input terminal of the light emitting element.

In an optional implementation, in the pixel circuit provided above according to an embodiment of the present disclosure, the driving module specifically comprises a fifth switching transistor and a capacitor;

a gate of the fifth switching transistor is connected with the first node, a drain of the fifth switching transistor is connected with the second node, and a source of the fifth switching transistor is connected with the input terminal of the light emitting element;

the capacitor is connected between the first node and the input terminal of the light emitting element.

An embodiment of the present disclosure provides a driving method for the pixel circuit provided above according to the embodiments of the present disclosure, comprising:

in a writing period, by the writing module, writing a signal from the data signal terminal to the first node under control of the first control signal and initializing, under control of the second control signal, the input terminal of the light emitting element by a signal inputted from the reference signal terminal;

in a light emitting period, outputting, by the selecting module, a signal from the first power supply signal terminal or a signal from the second power supply signal terminal to the second node under control of the first node and the second power supply signal terminal, and driving, by the driving module, under control of the first node, the light emitting element to emit light by a signal inputted from the second node.

An embodiment of the present disclosure provides a display panel, comprising the pixel circuit provided above according to the embodiments of the present disclosure.

An embodiment of the present disclosure provides a display device, comprising the display panel provided above according to the embodiment of the present disclosure.

The embodiments of the present disclosure provide a pixel circuit, a driving method for the pixel circuit, a display panel, and a display device. The pixel circuit comprises a selecting module, a writing module, a driving module, and a light emitting element; wherein the selecting module is configured to select a signal from the first power supply signal terminal or a signal from the second power supply signal terminal and to output the selected signal to the second node under control of the first node and the second power supply signal terminal; the driving module is configured to drive, under control of the first node, the light emitting element to emit light by a signal inputted by the second node; the writing module is configured to write a signal from the data signal terminal to the first node under control of the first control signal, and to initialize, under control of the second control signal, the input terminal of the light emitting element by a signal inputted from the reference signal terminal. In this way, the signal from the first power supply signal terminal or the signal from the second power supply signal terminal can be outputted to the second node by the selecting module, so that the driving module can drive the light emitting element to emit light by the signal inputted at the second node.

Specifically, the power supply signal for driving the light emitting element to emit light can be a signal from the first power supply signal terminal or a signal from the second power supply signal terminal. When a high-luminance picture needs to be displayed, the selecting module outputs the signal from the first power supply signal terminal to the second node, so that the signal from the first power supply signal terminal drives the light emitting element to emit light; when a low-luminance picture is to be displayed, the selecting module outputs a signal from the second power supply signal terminal to the second node, so that the signal from the second power source signal terminal drives the light emitting element to emit light. Accordingly, different power supply signals are adopted to drive the light emitting element to emit light when the high-luminance picture is displayed and the low-luminance picture is displayed, respectively, which facilitates improving utilization of the power supply signal, and reduces power consumption of the pixel circuit, thereby reducing power consumption of the display panel.

DETAILED DESCRIPTION OF THE EMBODIMENTS

Hereinafter, specific implementations of the pixel circuit, the driving method for the pixel circuit, the display panel, and the display device provided according to the embodiments of the present disclosure will be described in detail in combination with the drawings.

Figure 1:
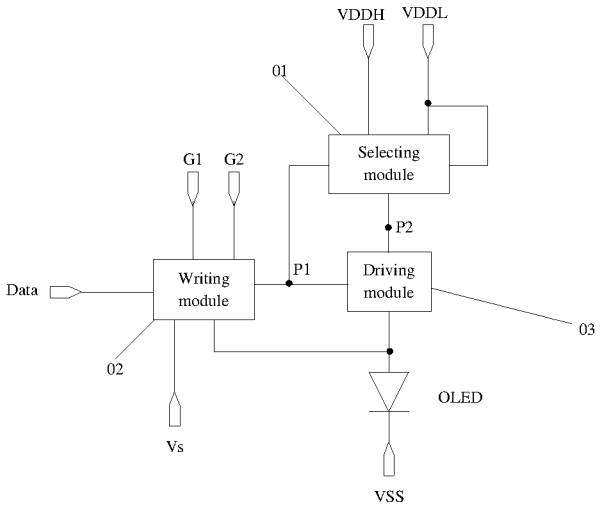
FIG. 1 is a schematic diagram of structure of a pixel circuit provided according to an embodiment of the present disclosure.

An embodiment of the present disclosure provides a pixel circuit, as illustrated in FIG. 1, the pixel circuit can comprise a selecting module 01, a writing module 02, a driving module 03, and a light emitting element OLED; wherein a first control terminal of the selecting module 01 is connected with a first node P1, a first input terminal of the selecting module 01 is connected with a first power supply signal terminal VDDH, a second control terminal and a second input terminal of the selecting module 01 are connected with a second power supply signal terminal VDDL, and an output terminal of the selecting module 01 is connected with a second node P2; the selecting module 01 is configured to select a signal from the first power supply signal terminal VDDH or a signal from the second power supply signal terminal VDDL and output the selected signal to the second node P2 under control of the first node P1 and the second power supply signal terminal VDDL;

a control terminal of the driving module 03 is connected with the first node P1, an input terminal of the driving module 03 is connected with the second node P2, and an output terminal of the driving module 03 is connected with an input terminal of the light emitting element OLED; the driving module 03 is configured to drive, under control of the first node P1, the light emitting element OLED to emit light by a signal inputted from the second node P2;

an output terminal of the light emitting element OLED is connected with a third power supply signal terminal VSS;

a first control terminal of the writing module 02 is configured to input a first control signal G1, a second control terminal of the writing module 02 is configured to input a second control signal G2, a first input terminal of the writing module 02 is connected with a data signal terminal Data, a second input terminal of the writing module 02 is connected with a reference signal terminal Vs, a first output terminal of the writing module 02 is connected with the first node P1, and a second output terminal of the writing module 02 is connected with the input terminal of the light emitting element OLED; the writing module 02 is configured to write a signal from the data signal terminal Data to the first node P1 under control of the first control signal G1, and to initialize, under control of the second control signal G2, the input terminal of the light emitting element OLED by a signal inputted from the reference signal terminal Vs.

In the pixel circuit provided above according to an embodiment of the present disclosure, the signal from the first power supply signal terminal or the signal from the second power supply signal terminal can be outputted to the second node by the selecting module, so that the driving module can drive the light emitting element to emit light by the signal inputted at the second node. Specifically, the power supply signal for driving the light emitting element to emit light can be a signal from the first power supply signal terminal or a signal from the second power supply signal terminal. When a high-luminance picture needs to be displayed, the selecting module outputs the signal from the first power supply signal terminal to the second node, so that the signal from the first power supply signal terminal drives the light emitting element to emit light; when a low-luminance picture is to be displayed, the selecting module outputs a signal from the second power supply signal terminal to the second node, so that thus the signal from the second power source signal terminal drives the light emitting element to emit light. Accordingly, different power supply signals are adopted to drive the light emitting element to emit light when the high-luminance picture is displayed and when the low-luminance picture is displayed, respectively, which facilitates improving utilization of the power supply signal, reducing power consumption of the pixel circuit, thereby reducing power consumption of the display panel.

Figure 2:
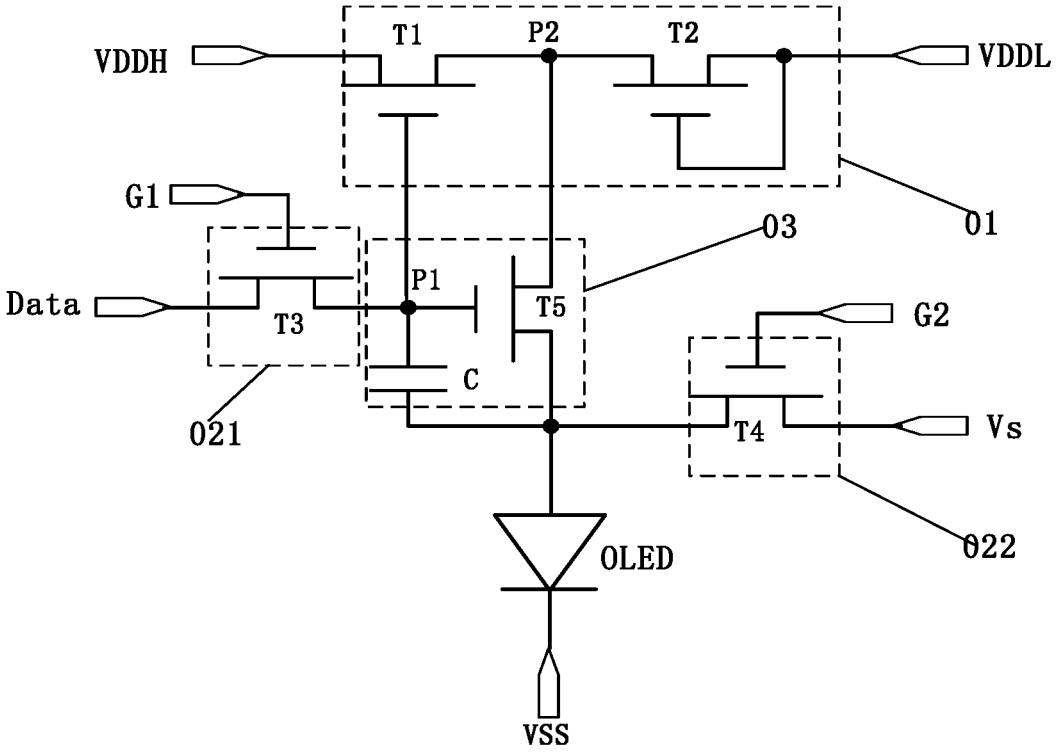
FIG. 2 is a schematic diagram of specific structure of the pixel circuit provided according to an embodiment of the present disclosure.

As a specific implementation, in the pixel circuit provided above according to an embodiment of the present disclosure, as illustrated in FIG. 2, the selecting module 01 can specifically comprise a first switching transistor T1 and a second switching transistor T2; a gate of the first switching transistor T1 is connected with the first node P1, a drain of the first switching transistor T1 is connected with the first power supply signal terminal VDDH, and a source of the first switching transistor T1 is connected with the second node P2; a gate and a source of the second switching transistor T2 are connected with the second power supply signal terminal VDDL, and a drain of the second switching transistor T2 is connected with the second node P2.

Specifically, in the pixel circuit provided above according to an embodiment of the present disclosure, in a case in which a signal is input at the first node, assuming that a potential at the first node is Va, since the gate and the source of the second switching transistor T2 are both connected to the second power supply signal terminal, the second switching transistor T2 is connected in the form of a diode and can output a signal from the second power supply signal terminal (e.g., a level provided at the second power supply signal terminal is VL) to the second node, so that a voltage difference between the gate and the source of the first switching transistor is Vgs=Va−VL. When Va−VL>Vth (Vth represents a threshold voltage of the first switching transistor), the first switching transistor is turned on, the second switching transistor is biased reversely, and the turned-on first switching transistor outputs a signal from the first power supply signal terminal (e.g., a level provided at the first power supply signal terminal is VH) to the second node, so that the power supply signal VH drives the light emitting element to emit light; when Va−VL<Vth, the first switching transistor is turned off, the second switching transistor is turned on, the turned-on second switching transistor outputs a signal VL from the second power supply signal terminal to the second node, so that the power supply signal VL drives the light emitting element to emit light.

As a specific implementation, in the pixel circuit provided above according to an embodiment of the present disclosure, as illustrated in FIG. 2, the writing module 02 can specifically comprise a data writing unit 021 and an initializing unit 022; a control terminal of the data writing unit 021 is configured to input the first control signal G1, an input terminal of the data writing unit 021 is connected with the data signal terminal Data, and an output terminal of the data writing unit 021 is connected with the first node P1; the data writing unit 021 is configured to write a signal from the data signal terminal Data to the first node P1 under control of the first control signal G1; a control terminal of the initializing unit 022 is used to input the second control signal G2, an input terminal of the initializing unit 022 is connected with the reference signal terminal Vs, and an output terminal of the initializing unit 022 is connected with the input terminal of the light emitting element OLED; the initializing unit 022 is configured to initialize, under control of the second control signal G2, the input terminal of the light emitting element OLED by a signal input from the reference signal terminal Vs.

Specifically, in the pixel circuit provided above according to an embodiment of the present disclosure, the writing module can comprise a data writing unit and an initializing unit, wherein the data writing unit can write a signal from the data signal terminal to the first node under control of the first control signal, and the initializing unit can initialize, under control of the second control signal, the input terminal of the light emitting element by a signal inputted from the reference signal.

As a specific implementation, in the pixel circuit provided above according to an embodiment of the present disclosure, as illustrated in FIG. 2, the data writing unit 021 can specifically comprise a third switching transistor T3, wherein a gate of the third switching transistor T3 is used to input the first control signal G1, a source of the third switching transistor is connected with the data signal terminal Data, and a drain of the third switching transistor is connected with the first node P1. Specifically, the third switching transistor can be turned on under control of the first control signal, so that the path between the data signal terminal and the first node conducts via the turned-on third switching transistor, and in turn a signal from the data signal terminal can be outputted to the first node.

As a specific implementation, in the pixel circuit provided above according to an embodiment of the present disclosure, as illustrated in FIG. 2, the initializing unit 022 can specifically comprise a fourth switching transistor T4; a gate of the fourth switching transistor T4 is used for inputting the second control signal G2, a source of the fourth switching transistor T4 is connected with the reference signal terminal Vs, and a drain of the fourth switching transistor T4 is connected with the input terminal of the light emitting element OLED. Specifically, the fourth switching transistor can be turned on under control of the second control signal, and the path between the reference signal terminal and the input terminal of the light emitting element conducts via the turned-on fourth switching transistor, so that a signal from the reference signal terminal can be outputted to the input terminal of the light emitting element, so as to initialize the input terminal of the light emitting element; in this way, the light emitting element is prevented from being in a positive bias state for a long time, thus slowing down an aging speed of the light emitting element.

As a specific implementation, in the pixel circuit provided above according to an embodiment of the present disclosure, as illustrated in FIG. 2, the driving module 03 can specifically comprise a fifth switching transistor T5 and a capacitor C, wherein a gate of the fifth switching transistor T5 is connected with the first node P1, a drain of the fifth switching transistor T5 is connected with the second node P2, and a source of the fifth switching transistor T5 is connected with the input terminal of the light emitting element OLED; the capacitor C is connected between the first node P1 and the input terminal of the light emitting element OLED. Specifically, the fifth switching transistor can be turned on under control of the first node, and the path between the second node and the input terminal of the light emitting element conducts via the turned-on fifth switching transistor, and in turn the light emitting element is driven to emit light by the power supply signal inputted at the second node.

It needs to be noted that the switching transistors mentioned in the above embodiments of the present disclosure can be TFT (Thin Film Transistor), can also be MOS (Metal Oxide Semiconductor), with no limitations made here. In a specific implementation, source and drain of these transistors can be interchanged, and no differentiation is made in particular. Description is provided with the TFT as an example in the embodiments.

Figure 3:
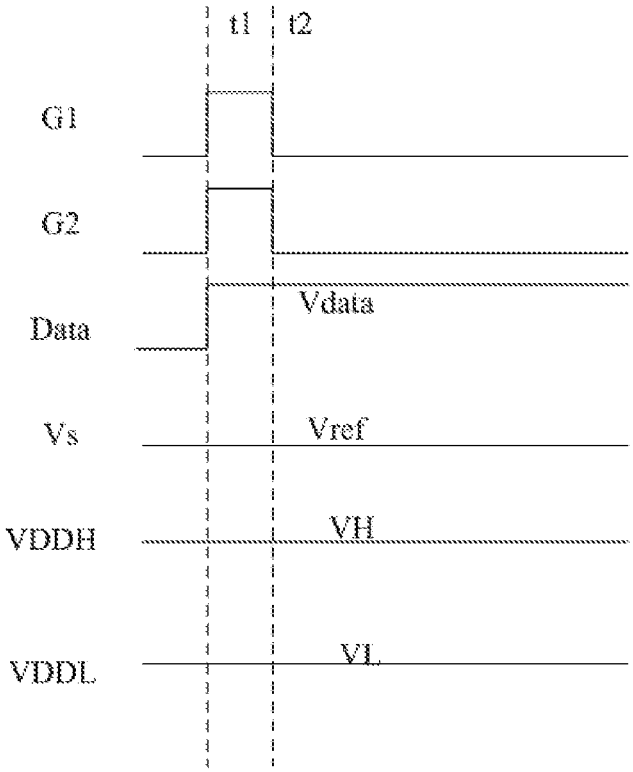
FIG. 3 is a schematic diagram illustrating input/output timing of the pixel circuit provided according to an embodiment of the present disclosure.

Next, an operating process of the pixel circuit provided according to an embodiment of the present disclosure will be described in detail in conjunction with the pixel circuit and the operation timing provided according to an embodiment of the present disclosure. The operating process of the pixel circuit provided according to an embodiment of the present disclosure is described by adopting the pixel circuit illustrated in FIG. 2 and the input/output timing diagram illustrated in FIG. 3. Specifically, two periods t1 to t2 in the input/output timing diagram as illustrated in FIG. 3 are selected. In the following description, 1 indicates that a signal is at a high level, 0 indicates that the signal is at a low level.

In the period t1, G1=1, G2=1, Data=Vdata, Vs=Vref, VDDH=VH, VDDL=VL. Since G1=1 and G2=1, the third switching transistor T3 and the fourth switching transistor T4 are turned on; the path between the data signal terminal Data and the first node P1 conducts via the turned-on third switching transistor, so that a signal Vdata inputted from the data signal terminal Data is outputted to the first node P; the path between the reference signal terminal Vs and the input terminal of the light emitting element OLED conducts via the turned-on fourth switching transistor T4, so that the signal Vref from the reference signal terminal Vs is outputted to the input terminal of the light emitting element OLED, so as to initialize the light-emitting element OLED; a voltage difference across two terminals of the capacitor C is Vdata-Vref. The period t1 is referred to as a writing period.

In the period t2, G1=0, G2=0, Data=Vdata, Vs=Vref, VDDH=VH, VDDL=VL. Since G1=0 and G2=0, the third switching transistor T3 and the fourth switching transistor T4 are turned off; the light emitting element OLED enters a light emitting period, and a potential at the input terminal of the light emitting element OLED is changed from Vref to Vo+Vss, where Vo represents a threshold voltage of the light emitting element OLED, Vss represents a potential at the third power supply signal terminal VSS; a potential at the other terminal of the capacitor C, i.e., the potential at the first node P1, is pulled up to Vdata−Vref+Vo+Vss due to an coupling effect of the capacitor C, and meantime, the gate-source voltage of the first switching transistor T1, Vgs=Vdata−Vref+Vo+Vss−VL. When a high-luminance picture is displayed, that is, the signal Vdata inputted from the data signal terminal is relatively large, for example a preset value Vm can also be set, i.e., when Vdata>Vm, the gate-source voltage of the first switching transistor T1, Vgs=Vdata−Vref+Vo+Vss−VL>Vth, so that the first switching transistor T1 is turned on, and the turned-on first switching transistor T1 outputs a signal VH from the first power supply signal terminal VDDH to the second node P2, and the second switching transistor T2 is biased reversely and is turned off, so that the signal VH from the first power supply signal terminal VDDH drives the light emitting element OLED to emit light. When a low-luminance picture is displayed, that is, the data Vdata inputted from the data signal terminal is relatively small, i.e., Vdata<Vm, the gate-source voltage of the first switching transistor T1, Vgs=Vdata−Vref+Vo+Vss−VL<Vth, so that the first switching transistor T1 is turned off, and meantime, the second switching transistor T2 in a form of a diode connection outputs a signal VL from the second power supply signal terminal VDDL to the second node P2, so that the signal VL from the second power supply signal terminal VDDL drives the light emitting element OLED to emit light. In this case, the gate-source voltage of the fifth switching transistor T5, Vgs5=Vdata−Vref+Vo+Vss−Vo−Vss=Vdata−Vref, so that a current for driving the light emitting element OLED to emit light is $I=K(Vgs5-Vth)^2=K(Vdata-Vref-Vth)^2$, where K represents a constant related to manufacturing parameters and geometrical dimensions of the fifth switching transistor T5, Vgs5 represents a voltage difference between the gate and the source of the fifth switching transistor T5. It can be seen that the current for driving the light emitting element OLED to emit light is independent of the signal Vss from the third power supply signal terminal VSS, thereby eliminating the influence of a voltage drop of the third power supply signal terminal VSS on luminance of the light emitting element, and improving the display uniformity of the display panel. The period t2 is referred to as a light emitting period.

It is to be noted that a width-length ratio of the first switching transistor is larger than that of the second switching transistor, so that the threshold voltage of the first switching transistor is smaller than the threshold voltage of the second switching transistor.

Based on the same inventive concept, an embodiment of the present disclosure provides a driving method for the pixel circuit provided above according to the embodiment of the present disclosure, and the method can specifically comprise:

in a writing period, by the writing module, writing a signal from the data signal terminal to the first node under control of the first control signal and initializing, under control of the second control signal, the input terminal of the light emitting element by a signal inputted from the reference signal terminal;

in a light emitting period, outputting, by the selecting module, a signal from the first power supply signal terminal or a signal from the second power supply signal terminal to the second node under control of the first node and the second power supply signal terminal, and driving, under control of the first node, by the driving module, the light emitting element to emit light by a signal inputted from the second node.

Specifically, in the driving method for the pixel circuit provided above according to an embodiment of the present disclosure, data writing and initializing of the input terminal of the light emitting element are completed in the writing period; and in the light emitting period, the signal from the first power supply signal terminal or the signal from the second power supply signal terminal is selected as a power supply signal for driving the light emitting element to emit light and outputted to the second node, so that the driving module, under control of the first node, drives the light emitting element to emit light by the signal inputted from the second node; in this way, different power supply signals are adopted to drive the light emitting element to emit light when displaying the high-luminance and the low-luminance picture, respectively, which facilitates improving utilization of the power supply signal, and reduces power consumption of the pixel circuit, thereby reducing power consumption of the display panel.

Based on the same inventive concept, an embodiment of the present disclosure provides a display panel comprising the pixel circuit provided above according to the embodiments of the present disclosure. Since this display panel adopts the principle similar to that the pixel circuit adopts, as for implementations of the pixel panel, reference can be made to implementations of the pixel circuit described above, without any more details repeated here.

Based on the same inventive concept, an embodiment of the present disclosure provides a display device, comprising the display panel described provided above according to the embodiments of the present disclosure. The display device can be applied to mobile phones, tablet computers, televisions, monitors, notebook computers, digital photo frames, navigators and any other products or components having a display function. Since the display device adopts the principle similar to that the display panel does, as for implementations of the pixel panel, reference can be made to implementations of the pixel circuit described above, without any more details repeated here.

The embodiments of the present disclosure provide a pixel circuit, a driving method for the pixel circuit, a display panel, and a display device. The pixel circuit comprises a selecting module, a writing module, a driving module, and a light emitting element; wherein the selecting module is configured to select a signal from the first power supply signal terminal or a signal from the second power supply signal terminal and to output the selected signal to the second node under control of the first node and the second power supply signal terminal; the driving module is configured to drive, under control of the first node, the light emitting element to emit light by a signal inputted by the second node; the writing module is configured to write a signal from the data signal terminal to the first node under control of the first control signal, and to initialize, under control of the second control signal, the input terminal of the light emitting element by a signal inputted from the reference signal terminal. In this way, the signal from the first power supply signal terminal or the signal from the second power supply signal terminal can be selected and outputted to the second node by the selecting module, so that the driving module can drive the light emitting element to emit light by the signal inputted at the second node.

Specifically, the power supply signal for driving the light emitting element to emit light can be a signal from the first power supply signal terminal or a signal from the second power supply signal terminal. When a high-luminance picture needs to be displayed, the selecting module selects and outputs the signal from the first power supply signal terminal to the second node, so that the signal from the first power supply signal terminal drives the light emitting element to emit light; when a low-luminance picture is to be displayed, the selecting module selects and outputs a signal from the second power supply signal terminal to the second node, so that the signal from the second power source signal terminal drives the light emitting element to emit light. Accordingly, different power supply signals are adopted to drive the light emitting element to emit light when the high-luminance picture and the low-luminance picture are displayed respectively, which facilitates improving utilization of the power supply signal, and reduces power consumption of the pixel circuit, thereby reducing power consumption of the display panel.

Obviously, those skilled in the art can make various modifications and variations to the present disclosure without departing from the spirit and scope thereof. Thus, provided that these modifications and variations of the present disclosure are within the scope of the claims of the disclosure as well as their equivalents, the present disclosure is also intended to cover these modifications and variations.

The present application claims priority of the Chinese Patent Application No. 201610005980.3 filed on Jan. 5, 2016, the entire disclosure of which is hereby incorporated in full text by reference as part of the present application.

What is claimed is:

1. A pixel circuit, comprising a selecting module, a writing module, a driving module, and a light emitting element, wherein a first control terminal of the selecting module is connected with a first node, a first input terminal of the selecting module is connected with a first power supply signal terminal, a second control terminal and a second input terminal of the selecting module are connected with a second power supply signal terminal, and an output terminal of the selecting module is connected with a second node; the selecting module is configured to select a signal from the first power supply signal terminal or a signal from the second power supply signal terminal and to output the selected signal to the second node under control of the first node and the second power supply signal terminal;

a control terminal of the driving module is connected with the first node, an input terminal of the driving module is connected with the second node, and an output terminal of the driving module is connected with an input terminal of the light emitting element; the driving module is configured to drive, under control of the first node, the light emitting element to emit light according to a signal inputted from the second node, the signal inputted from the second node corresponds to the signal from the first power supply signal terminal or the signal from the second power supply signal terminal;

an output terminal of the light emitting element is connected with a third power supply signal terminal;

a first control terminal of the writing module is configured to receive a first control signal, a second control terminal of the writing module is configured to receive a second control signal, a first input terminal of the writing module is connected with a data signal terminal, a second input terminal of the writing module is connected with a reference signal terminal, a first output terminal of the writing module is connected with the first node, and a second output terminal of the writing module is connected with the input terminal of the light emitting element; the writing module is configured to write a signal from the data signal terminal to the first node under control of the first control signal, and to initialize, under control of the second control signal, the input terminal of the light emitting element by a signal inputted from the reference signal terminal.

2. The pixel circuit according to claim 1, wherein the selecting module comprises a first switching transistor and a second switching transistor;

a gate of the first switching transistor is connected with the first node, a drain of the first switching transistor is connected with the first power supply signal terminal, and a source of the first switching transistor is connected with the second node;

a gate and a source of the second switching transistor are connected with the second power supply signal terminal, and a drain of the second switching transistor is connected with the second node.

3. The pixel circuit according to claim 1, wherein the writing module comprises a data writing unit and an initializing unit;

a control terminal of the data writing unit is configured to receive the first control signal, an input terminal of the data writing unit is connected with the data signal terminal, and an output terminal of the data writing unit is connected with the first node; the data writing unit is configured to write a signal from the data signal terminal to the first node under control of the first control signal;

a control terminal of the initializing unit is configured to receive the second control signal, an input terminal of the initializing unit is connected with the reference signal terminal, and an output terminal of the initializing unit is connected with the input terminal of the light emitting element; the initializing unit is configured to initialize, under control of the second control signal, the input terminal of the light emitting element by a signal inputted from the reference signal terminal.

4. The pixel circuit according to claim 3, wherein the data writing unit comprises a third switching transistor;

a gate of the third switching transistor is configured to receive the first control signal, a source of the third switching transistor is connected with the data signal terminal, and a drain of the third switching transistor is connected with the first node.

5. The pixel circuit according to claim 3, wherein the initializing unit comprises a fourth switching transistor;

a gate of the fourth switching transistor is configured to receive the second control signal, a source of the fourth switching transistor is connected with the reference signal terminal, and a drain of the fourth switching transistor is connected with the input terminal of the light emitting element.

6. The pixel circuit according to claim 1, wherein the driving module comprises a fifth switching transistor and a capacitor;

a gate of the fifth switching transistor is connected with the first node, a drain of the fifth switching transistor is connected with the second node, and a source of the fifth switching transistor is connected with the input terminal of the light emitting element;

the capacitor is connected between the first node and the input terminal of the light emitting element.

7. A driving method for the pixel circuit according to claim 1, comprising:

in a writing period, by the writing module, writing a signal from the data signal terminal to the first node under control of the first control signal, and initializing, under control of the second control signal, the input terminal of the light emitting element by a signal inputted from the reference signal terminal;

in a light emitting period, outputting, by the selecting module, a signal from the first power supply signal terminal or a signal from the second power supply signal terminal to the second node under control of the first node and the second power supply signal terminal, and driving, by the driving module, under control of the first node, the light emitting element to emit light according to a signal inputted from the second node, the signal inputted from the second node corresponds to the signal from the first power supply signal terminal or the signal from the second power supply signal terminal.

8. A display panel, comprising the pixel circuit according to claim 1.

9. A display device, comprising the display panel according to claim 8.

10. The display device according to claim 9, wherein the selecting module comprises a first switching transistor and a second switching transistor;

a gate of the first switching transistor is connected with the first node, a drain of the first switching transistor is connected with the first power supply signal terminal, and a source of the first switching transistor is connected with the second node;

a gate and a source of the second switching transistor are connected with the second power supply signal terminal, and a drain of the second switching transistor is connected with the second node.

11. The display device according to claim 9, wherein the writing module comprises a data writing unit and an initializing unit;

a control terminal of the data writing unit is configured to receive the first control signal, an input terminal of the data writing unit is connected with the data signal terminal, and an output terminal of the data writing unit is connected with the first node; the data writing unit is configured to write a signal from the data signal terminal to the first node under control of the first control signal;

a control terminal of the initializing unit is configured to receive the second control signal, an input terminal of the initializing unit is connected with the reference signal terminal, and an output terminal of the initializing unit is connected with the input terminal of the light emitting element; the initializing unit is configured to initialize, under control of the second control signal, the input terminal of the light emitting element by a signal inputted from the reference signal terminal.

12. The display device according to claim 11, wherein the data writing unit comprises a third switching transistor;

a gate of the third switching transistor is configured to receive the first control signal, a source of the third switching transistor is connected with the data signal terminal, and a drain of the third switching transistor is connected with the first node.

13. The display device according to claim 11, wherein the initializing unit comprises a fourth switching transistor;

a gate of the fourth switching transistor is configured to receive the second control signal, a source of the fourth switching transistor is connected with the reference signal terminal, and a drain of the fourth switching transistor is connected with the input terminal of the light emitting element.

14. The display device according to claim 9, wherein the driving module comprises a fifth switching transistor and a capacitor;

a gate of the fifth switching transistor is connected with the first node, a drain of the fifth switching transistor is connected with the second node, and a source of the fifth switching transistor is connected with the input terminal of the light emitting element;

the capacitor is connected between the first node and the input terminal of the light emitting element.

15. The display panel according to claim 8, wherein the selecting module comprises a first switching transistor and a second switching transistor;

a gate of the first switching transistor is connected with the first node, a drain of the first switching transistor is connected with the first power supply signal terminal, and a source of the first switching transistor is connected with the second node;

a gate and a source of the second switching transistor are connected with the second power supply signal terminal, and a drain of the second switching transistor is connected with the second node.

16. The display panel according to claim 8, wherein the writing module comprises a data writing unit and an initializing unit;

a control terminal of the data writing unit is configured to receive the first control signal, an input terminal of the data writing unit is connected with the data signal terminal, and an output terminal of the data writing unit is connected with the first node; the data writing unit is configured to write a signal from the data signal terminal to the first node under control of the first control signal;

a control terminal of the initializing unit is configured to receive the second control signal, an input terminal of the initializing unit is connected with the reference signal terminal, and an output terminal of the initializing unit is connected with the input terminal of the light emitting element; the initializing unit is configured to initialize, under control of the second control signal, the input terminal of the light emitting element by a signal inputted from the reference signal terminal.

17. The display panel according to claim 16, wherein the data writing unit comprises a third switching transistor;

a gate of the third switching transistor is configured to receive the first control signal, a source of the third switching transistor is connected with the data signal terminal, and a drain of the third switching transistor is connected with the first node.

18. The display panel according to claim 16, wherein the initializing unit comprises a fourth switching transistor;

a gate of the fourth switching transistor is configured to receive the second control signal, a source of the fourth switching transistor is connected with the reference signal terminal, and a drain of the fourth switching transistor is connected with the input terminal of the light emitting element.

19. The display panel according to claim 8, wherein the driving module comprises a fifth switching transistor and a capacitor;

a gate of the fifth switching transistor is connected with the first node, a drain of the fifth switching transistor is connected with the second node, and a source of the fifth switching transistor is connected with the input terminal of the light emitting element;

the capacitor is connected between the first node and the input terminal of the light emitting element.

* * * * *